US010575618B2

(12) United States Patent
Tereschouk

(10) Patent No.: US 10,575,618 B2
(45) Date of Patent: Mar. 3, 2020

(54) APPLICATOR OF LIQUIDS FROM OPENABLE CAPSULES

(71) Applicant: Misha Tereschouk, Frankfurt (DE)

(72) Inventor: Misha Tereschouk, Frankfurt (DE)

(73) Assignee: COMPHARM, Frankfurt (DE)

( * ) Notice: Subject to any disclaimer, the term of this patent is extended or adjusted under 35 U.S.C. 154(b) by 0 days.

(21) Appl. No.: 15/751,868

(22) PCT Filed: Sep. 11, 2016

(86) PCT No.: PCT/EP2016/071387

§ 371 (c)(1),
(2) Date: Feb. 11, 2018

(87) PCT Pub. No.: WO2017/050596

PCT Pub. Date: Mar. 30, 2017

(65) Prior Publication Data

US 2018/0249806 A1 Sep. 6, 2018

Related U.S. Application Data

(60) Provisional application No. 62/221,651, filed on Sep. 22, 2015.

(51) Int. Cl.
*A45D 34/04* (2006.01)

(52) U.S. Cl.
CPC ..... *A45D 34/04* (2013.01); *A45D 2200/1045* (2013.01)

(58) Field of Classification Search
CPC ..... A45D 34/04; A45D 2200/1036; A45D 2200/1045
See application file for complete search history.

(56) References Cited

U.S. PATENT DOCUMENTS 4,665,901 A * 5/1987 Spector ..... A61M 35/006 15/227
7,419,321 B2 * 9/2008 Tereschouk ..... A45D 34/04 401/132

(Continued)

FOREIGN PATENT DOCUMENTS

WO WO 2017/050596 * 3/2017 ..... A45D 34/04

*Primary Examiner* — J C Jacyna

(57) ABSTRACT

A hand applicator of liquids from openable capsules includes (from top to bottom) a semi-rigid membrane (1), an unfolding impermeable membrane (5), an openable capsule (6), a non-collapsible concave dissector (8), and an absorber (9) and is welded with a rounded edge seam (10). The semirigid membrane (1) comprises a fixed portion (11), a raisable grip (2), and a means for raising the grip (2)—a bending segment (3) or an edge cut-out (4) of the grip (2). The grip (2) and the segment (3) are congruently cut-through and connected by breakable bridges (15). The segment (3) bends down to enable a finger access under the grip (2) to raise the grip (2) and break the capsule (6). The grip (2) includes stiffeners (14), a diametrical hinge (12) with a more pliable central part (13), and a means (21) for opening the capsule (6). The impermeable membrane (5) unfolds and elongates to allow the finger to break the capsule (6) and includes a flat edge (16). The capsule (6) contains a liquid (7) and an actuator (20). The dissector (8) includes elevations (18) on the inside forming an unobstructed drainable space (17) and perforations (19).

16 Claims, 7 Drawing Sheets

(56) References Cited

U.S. PATENT DOCUMENTS

| | | | | |
|---|---|---|---|---|
| 7,997,454 | B2 * | 8/2011 | LaFlamme | A45D 34/04 222/207 |
| 2004/0258457 | A1 * | 12/2004 | Legendre | A45D 33/00 401/205 |
| 2010/0074671 | A1 * | 3/2010 | Prax | A45D 34/04 401/133 |
| 2014/0234008 | A1 * | 8/2014 | Tereschouk | A45D 34/04 401/132 |
| 2014/0348568 | A1 * | 11/2014 | Ooba | A45D 34/04 401/258 |
| 2015/0230585 | A1 * | 8/2015 | Chung | A45D 34/00 401/198 |

* cited by examiner

APPLICATOR OF LIQUIDS FROM OPENABLE CAPSULES

BACKGROUND OF THE INVENTION

1. Field of the Invention

The invention relates to cosmetics, personal care, pharmaceuticals, and household chemicals and more particularly to manual applicators of encapsulated liquids for cosmetic, hygienic, medical, or domestic purposes.

2. Description of the Prior Art

Patents granted for the international application PCT/IB2013/000943 (Tereschouk) disclose a hand applicator of encapsulated liquids for their even distribution on surfaces. The applicator includes the upper side (outer, semi-rigid, and impermeable membranes), a capsule of a liquid, an evenly perforated dissector, and the working side (an absorber) and is characterized in that the dissector is non-collapsible semi-rigid concave and contains the entire capsule. The upper side is flat and non-folding. The dissector has elevations on the inside. The impermeable membrane and capsule may be permanently fixed together or have a common wall. The capsule is an easily peelable, high-barrier blister that may include an aid for its opening at a predetermined location. The upper side, dissector, and working side are welded together along the edge of the applicator with a rounded seam that essentially follows the spherical curvature of the dissector. The semi-rigid membrane has an aperture over the capsule and a cut-through handle with a diametrical perforation hinge at its base and stiffeners.

A limitation of the applicator is the difficulty bringing it into the working (ready for application) position. Upon a finger pressure on the fixed portion of the semi-rigid membrane, the handle hardly turns around the hinge and rises not enough for the user to grasp the handle edge and bring it into the working vertical position. The impermeable membrane, although thin and flexible, is not stretchable to allow the user to pull the finger through it to compress and crash the capsule against the dissector. However, a usage of elastic (stretchable) materials for the impermeable membrane would deteriorate the applicator edge seam quality (sealability and mechanical stability).

Accordingly, the overall object of this invention is to accelerate bringing the applicator into the working position by making the grip easier raisable and the capsule easier openable.

SUMMARY OF THE INVENTION

The invention is a hand applicator of liquids from openable capsules that can be readily brought into the working position. The applicator includes (from top to bottom) a semi-rigid membrane, an unfolding impermeable membrane, an openable capsule of a liquid, a non-collapsible semi-rigid concave dissector, and an absorber and is sealed (welded) together with a rounded edge seam.

The semi-rigid membrane comprises a fixed portion, a raisable grip, and a means for raising the grip (a bending segment opposite the grip or an edge cut-out of the grip). In a preferred embodiment, the grip and the segment are congruently cut through the semi-rigid membrane and connected by a tiny bridge. When the user's finger presses on the segment, the bridge breaks up, the segment bends down, the finger slips under the grip centrally, raises the grip from below as it turns around the diametrical hinge at its base, and pulls down to break the capsule. Alternatively, the user grasps the grip at the cut-out and raises it into the vertical working position. The hinge may have a more pliable central part that has greater density or size of perforations or is thinner than the rest of the hinge.

The impermeable membrane is folded (corrugated) in the storage position, except for its flat edge that is welded into the applicator edge seam. When the user's finger presses on the openable capsule through the impermeable membrane, the membrane unfolds and elongates to allow the finger to compress the capsule against the semi-rigid dissector to crash and empty it.

An applicator with the fastest access to the openable capsule has the impermeable membrane at its top outside. The user can see through a transparent impermeable membrane multiple marked capsules inside the applicator and press directly onto a desired one to open it.

The capsule may include an actuator to restore the viscosity and homogeneity of liquids upon gently shaking the applicator before use.

The grip may include a means for opening the capsule upon turning the grip into the vertical working position. The means has a free flat semicircular extension beyond the grip hinge under the fixed portion of the semi-rigid membrane that essentially matches the shallowest profile of the concave dissector.

DETAILED DESCRIPTION OF THE INVENTION

Figure 1A:
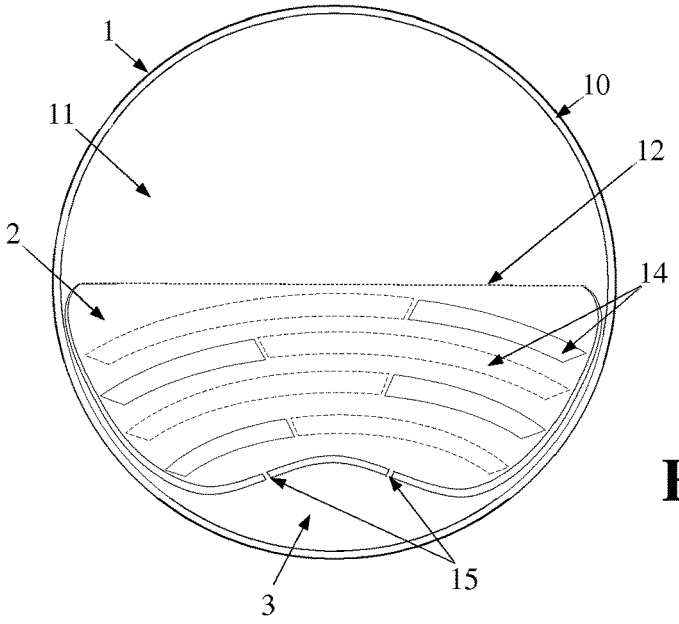
FIG. 1A is a top view of the applicator (with a bending segment opposite the grip) in the storage position.

The invention is a hand applicator of the liquid from an openable capsule that can be easily and quickly brought by the user from the storage into the working (ready for application) position. The applicator includes (from top to bottom) a semi-rigid membrane 1 (FIGS. 1A-1E, 3A-3D) with a raisable grip 2 and a means for raising the grip 2 (a bending segment 3 or an edge cut-out 4), an unfolding impermeable membrane 5 (FIGS. 1C-1E, 2A-2D, 3A-3D, 4A, 4B), an openable capsule 6 of a liquid 7 (FIGS. 3A-3D, 4A, 4B), an evenly perforated non-collapsible semi-rigid concave dissector 8 (FIGS. 3A-3D, 4B), and an absorber 9 (FIGS. 1B-1E, 3A-3D, 4B) that comes in contact with treated surfaces. The semi-rigid membrane 1, impermeable membrane 5, dissector 8, and absorber 9 are assembled (sealed) into the applicator (preferably, welded together along the edge of the applicator) with a rounded seam 10 (FIGS. 1A-1E, 3A-3D, 4A, 4B) that essentially follows the spherical curvature of the dissector 8.

In a preferred embodiment, the semi-rigid membrane 1 forms the top the outside of the applicator—it makes up the entire top view of the applicator in the storage position FIG. 1A. The semi-rigid membrane 1 comprises a fixed portion 11, a raisable cut-through grip 2 (FIGS. 1A-1E, 3A-3D), and a means for raising the grip (the bending segment 3 opposite the grip 2 [FIGS. 1A-1C, 3A, 3B] or the edge cut-out 4 of the grip 2 [FIGS. 1D, 3C]). The fixed portion 11 constitutes about one-half of the total area of the semi-rigid membrane 1 (FIG. 1A), participates in the applicator edge seam 10, and contributes to the mechanical stability of the applicator.

In a preferred embodiment, the grip 2 includes a diametrical hinge 12 at its base with a more pliable central part 13 as well as stiffeners 14 (solid lines in FIGS. 1A-1E correspond to elevated and dashed lines to depressed stiffeners 14). The more pliable central part 13 facilitates the rise of the grip 2 without compromising its mechanical stability and can be implemented as greater density (13*a*) or size (13*b*) of central perforations in a perforation hinge (FIG. 1F) or as a still thinner central part of a thinning-based hinge.

Figure 1B:
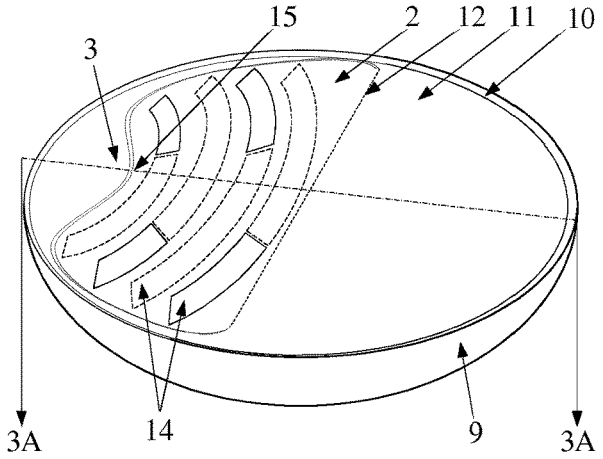
FIG. 1B is a front perspective view of the applicator (with a bending segment opposite the grip) in the storage position.
Figure 1C:
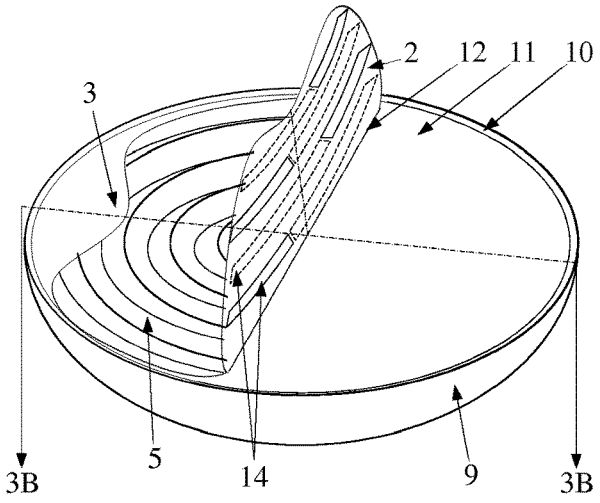
FIG. 1C is a front perspective view of the applicator (with a bending segment opposite the grip) in the working position.
Figure 3A:
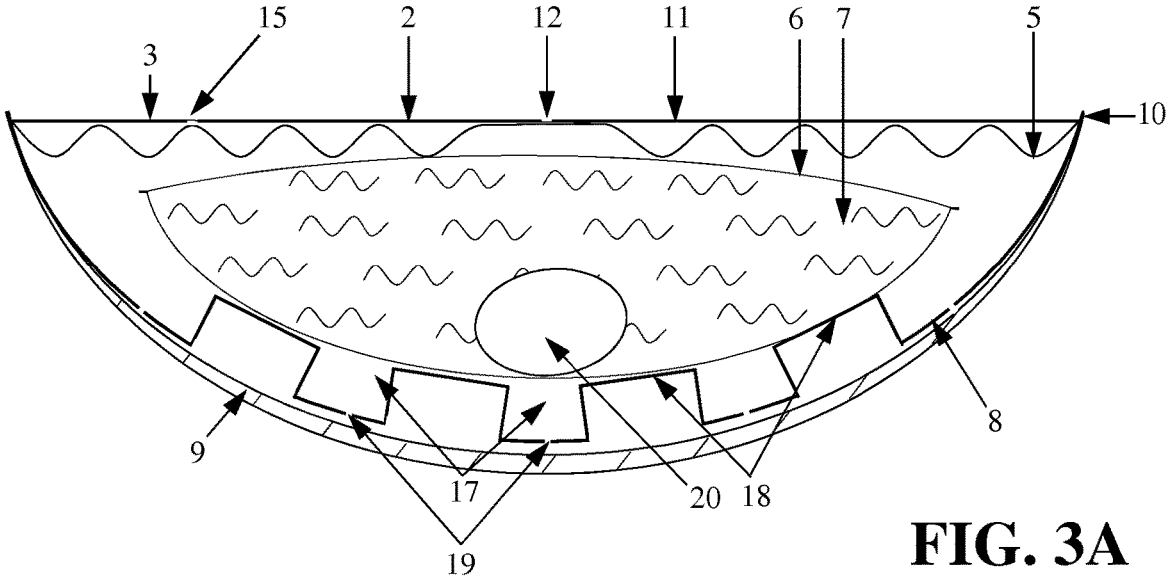
FIG. 3A is a front cross-sectional view of the applicator taken along line 3A-3A in FIG. 1B.

In a preferred embodiment shown in the front perspective view FIG. 1B and the respective cross-section FIG. 3A of the applicator in the storage position, the means for raising the grip is implemented as a bending segment 3 that extends from the applicator edge in the central direction and has a free flexible bending edge opposite the grip 2. In a preferred embodiment, the grip 2 and the segment 3 have congruent opposite sides (are congruently cut through the semi-rigid membrane 1) with smooth rounded edges and are connected in the storage state by one (FIGS. 1B, 3A) or more (FIG. 1A) tiny breakable bridges 15 that ensure the integrity of the applicator and its even upper surface during the storage. The segment 3 enables the user's finger access under the grip 2 to bring the applicator into the working position (to raise the grip 2 and open the capsule 6): the finger presses on the segment 3, the bridges 15 break up, the flexible edge of the segment 3 bends down, the finger slips under the grip 2 centrally, raises the grip 2 from below as the grip 2 turns around the hinge 12, and pulls down to break the capsule 6 by compressing it against the dissector 8. The user then grasps the edge of the grip 2 to bring it further up into the vertical position. The segment 3 can have a various shape (e.g., it can be a jut shown in FIGS. 1A-C or a straight segment) on condition that its free edge can bend down sufficiently to allow the user an easy finger access under the grip 2. FIG. 1C is a front perspective view of the applicator in the working position that shows an exposed part of the impermeable membrane 5, onto which the user may additionally press to squeeze the rest of the liquid 7 out of the capsule 6 (see the respective cross-section FIG. 3B). The impermeable membrane 5 may be transparent to easier locate the capsule 6 or, in the case of a plurality of capsules 6, to choose the one to open.

Figure 1D:
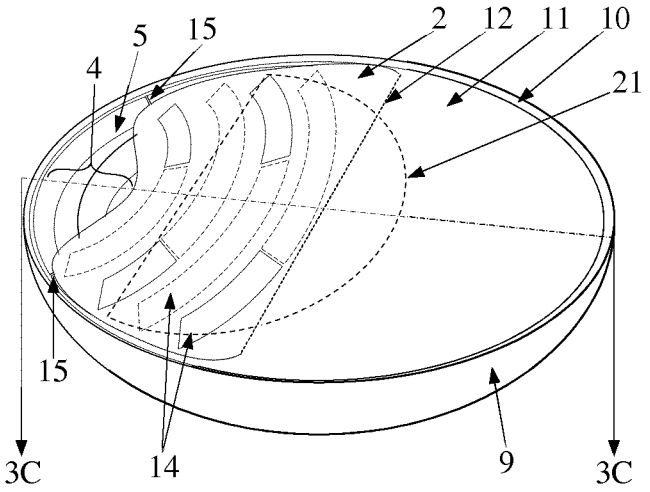
FIG. 1D is a front perspective view of the applicator (with an edge cut-out of the grip) in the storage position.
Figure 3B:
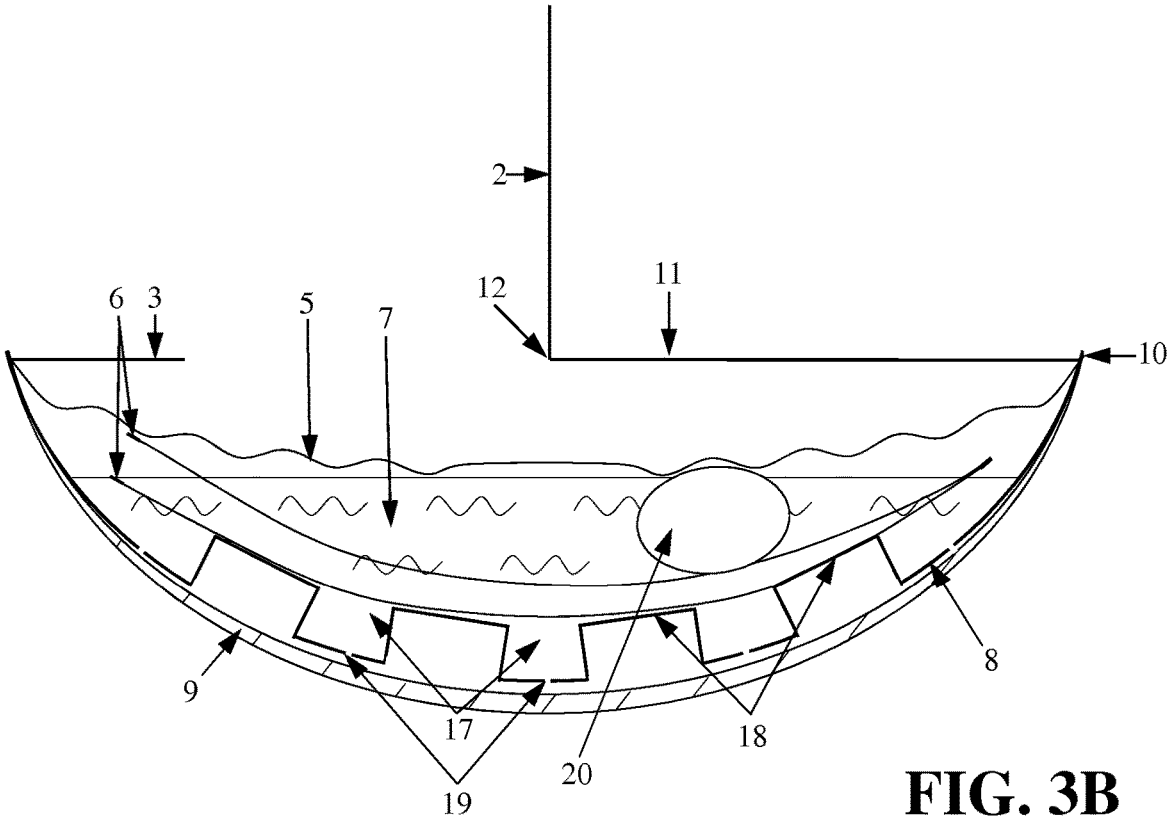
FIG. 3B is a front cross-sectional view of the applicator taken along line 3B-3B in FIG. 1C.
Figure 3C:
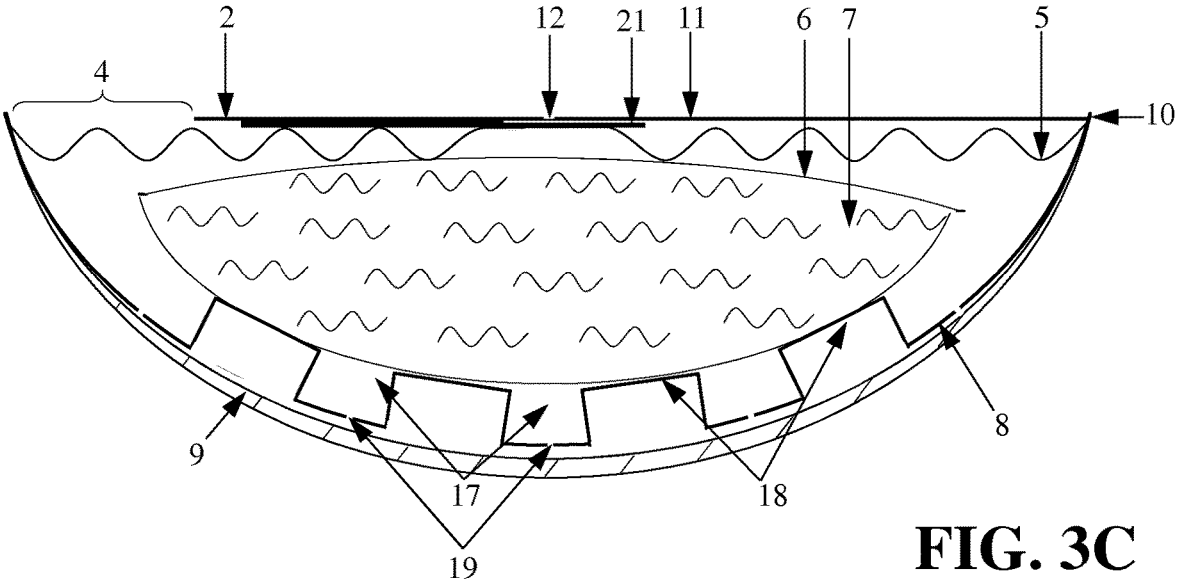
FIG. 3C is a front cross-sectional view of the applicator taken along line 3C-3C in FIG. 1D.

A front perspective view of the applicator FIG. 1D and the respective cross-section FIG. 3C show the applicator in the storage position where the means for raising the grip is implemented as an edge cut-out 4 of the grip 2 (FIG. 1D shows a small part of the impermeable membrane 5 exposed through the cut-out 4). The cut-out 4 can have a various shape on condition that this enables an easily grasping of the grip 2. The grip 2 may be cut through the semi-rigid membrane 1 in such a way that the opposite sides of the grip 2 and the semi-rigid membrane 1 (the narrow strip remaining along the edge seam 10) stay connected by one or, preferably, two symmetrical (on both sides) tiny breakable bridges 15 that ensure the integrity of the applicator and its even upper surface during the storage. The user grasps the grip 2 at the cut-out 4 and raises it into the vertical working position as the bridges 15 break up and the grip 2 turns around the hinge 12 at its base (see a front perspective view of the applicator in the working position FIG. 1E and its cross-section FIG. 3D).

Figure 2A:
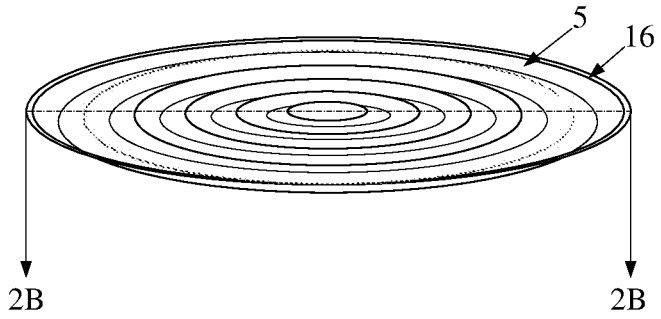
FIG. 2A is a front perspective view of the impermeable membrane in the storage (folded) position.
Figure 2B:
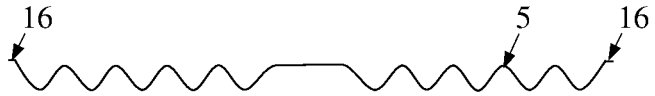
FIG. 2B is a front cross-sectional view of impermeable membrane taken along line 2B-2B in FIG. 2A.
Figure 2C:
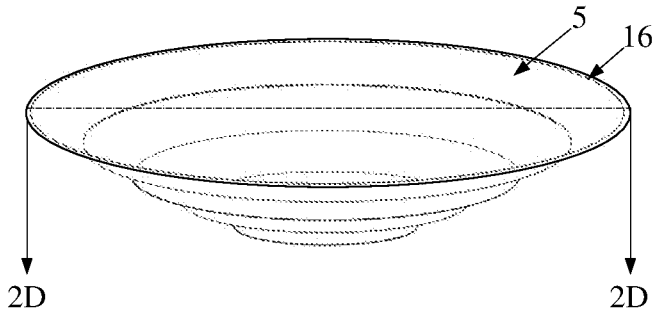
FIG. 2C is a front perspective view of the impermeable membrane in the working (unfolded) position.
Figure 2D:
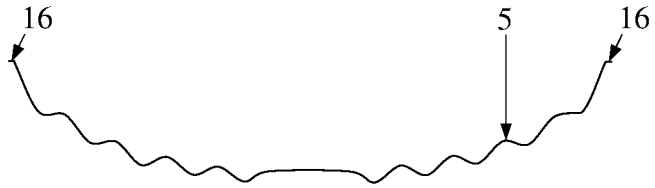
FIG. 2D is a front cross-sectional view of impermeable membrane taken along line 2D-2D in FIG. 2C.

The unfolding impermeable membrane 5 of this invention is folded (corrugated) in the storage position, except for its flat edge 16 that is welded with other parts of the applicator into a rounded seam 10 upon the applicator assembly. Different folding patterns may be used, such as concentric waves (FIGS. 2A-2D) for round applicators or pyramidal steps for square applicators. FIG. 2A is a front perspective view of the impermeable membrane 5 in the storage (folded) position (bold concentric lines correspond to elevations and fine concentric lines to depressions). The wavy pattern of the impermeable membrane 5 is clearly seen in the cross-sectional view FIG. 2B. The folded impermeable membrane 5 does not occupy much extra space between the semi-rigid membrane 1 and the capsule 6 and resiliently and gently fixes the capsule 6 (see cross-sections of the applicator in the storage position FIGS. 3A, 3C). When the finger presses on the openable capsule 6 through the folded impermeable membrane 5, the latter easily unfolds (straightens) and sufficiently elongates in the direction of the pressure (as shown in the front perspective view in the working position FIG. 2C and the respective cross-section FIG. 2D) to allow the finger to compress the capsule 6 against the semi-rigid dissector 8 to crash and empty it (see cross-sections of the applicator in the working position FIG. 3B, 3D). The released liquid 7 flows through the unobstructed drainable space 17 formed by elevations 18 on the dissector 8 inside and then through multiple perforations 19 of the dissector 8 outward to infuse the soft absorber 9 lining the dissector 8 outside. In a preferred embodiment, the unfolding impermeable membrane 5 is produced out of a thin thermoplastic non-elastic (non-stretchable) sheet that is chemically inert to ingredients of the encapsulated liquid 7 and compatible for welding with other non-elastic parts of the applicator (semi-rigid membrane 1 and dissector 8).

An applicator of the same size may include a capsule 6 of a lower volume (e.g., for fragrances). In such a case, the shape of the impermeable membrane 5 is adjusted during thermoforming to the smaller capsule 6 size. The front cross-sectional view of the applicator in the storage position FIG. 3E (a variant for smaller capsules of the view FIG. 3A) shows a bent-down impermeable membrane 5 that accommodates a smaller capsule 6.

Figure 4A:
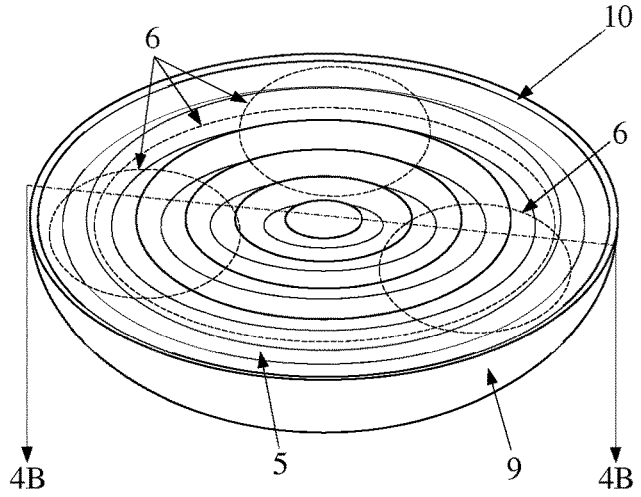
FIG. 4A is a front perspective view of the applicator (with the impermeable membrane as its top outside) in the storage position.
Figure 4B:
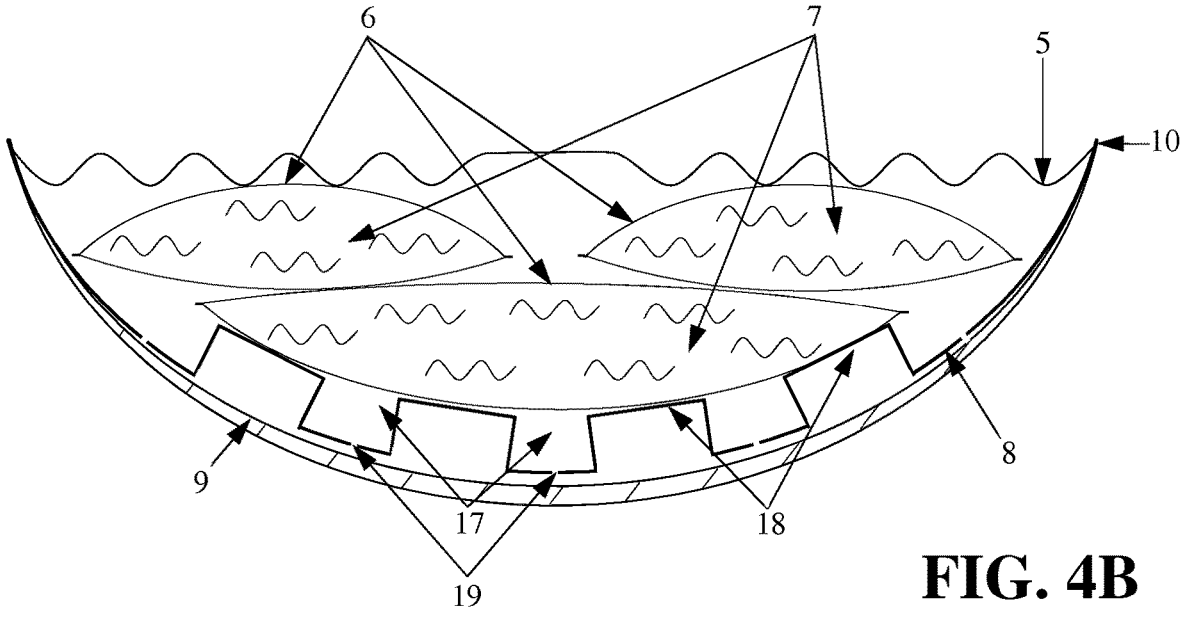
FIG. 4B is a front cross-sectional view of the applicator taken along line 4B-4B in FIG. 4A.

In another embodiment, the folded impermeable membrane 5 forms the top outside of the applicator. As shown in the front perspective view of the applicator in the storage position FIG. 4A and the respective cross-section FIG. 4B, this embodiment ensures an immediate access to openable capsules 6 by pressing through an impermeable membrane 5 essentially at any location on the applicator top side and requires less parts and manufacturing operations due to the absence of the semi-rigid membrane 1. This embodiment particularly suits an applicator with multiple marked capsules 6 that the user can see through a transparent impermeable membrane 5 and press directly onto a desired one to open it (the contours of four capsules 6 are indicated in FIG. 4A by dashed circles; three of the four capsules are seen in the cross-section FIG. 4B). However, the absence of the semi-rigid membrane 1, which would protect the capsule 6 from above, requires a careful handling of the applicator 1 (e.g., placing the applicator upside down on a flat rigid packaging surface), and the absence of a grip 2 leaves the user with the necessity holding the applicator by its edge during an application.

For formulations with an insufficient stability (thixotropic viscosity, phase separation, precipitation, etc.), the capsule 6 may include one or more chemically inert and relatively heavy actuators 20, such as glass or inert-plastic-covered metal flattened pellets, that would restore the viscosity and homogeneity of the liquid 7 upon gently shaking the applicator 1 before use (FIGS. 3A, 3B). The actuator 20 should be greater than the size of perforations 19 of the dissector 8 and, preferably, greater than the distance between elevations 18 to preclude blocking of the perforations 19.

Figure 1E:
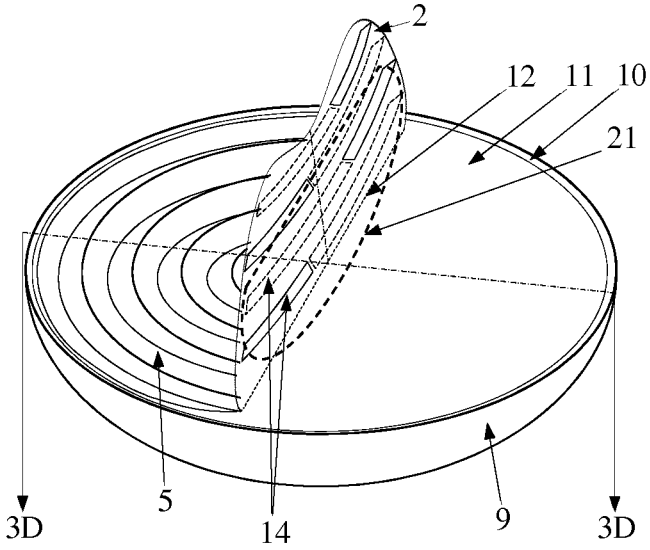
FIG. 1E is a front perspective view of the applicator (with an edge cut-out of the grip) in the working position.
Figure 1F:
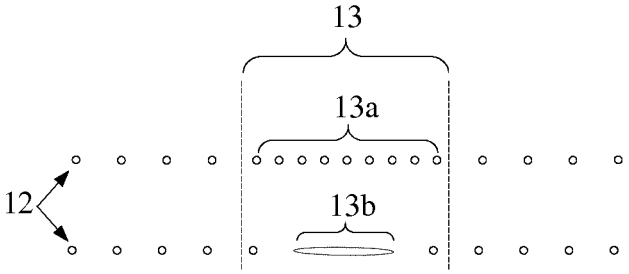
FIG. 1F is a top view of the perforation hinge of the grip of the applicator.
Figure 3D:
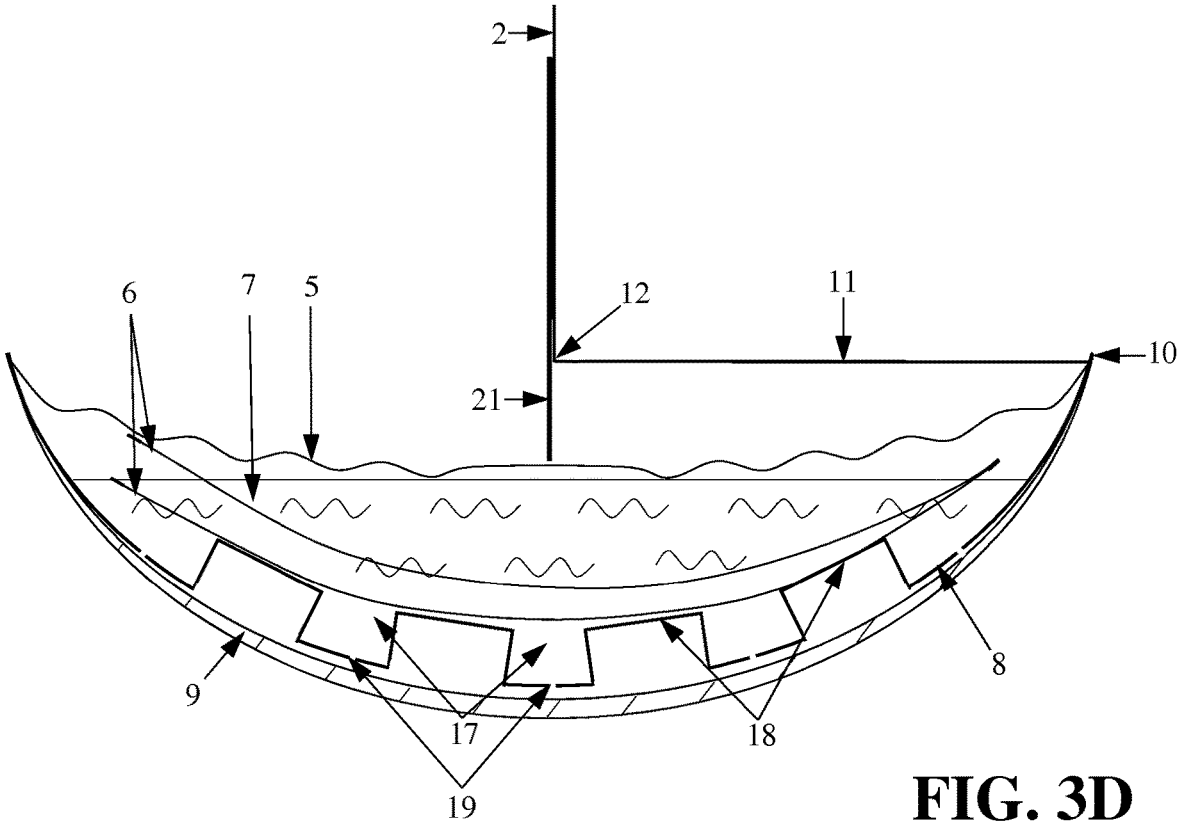
FIG. 3D is a front cross-sectional view of the applicator taken along line 3D-3D in FIG. 1E.
Figure 3E:
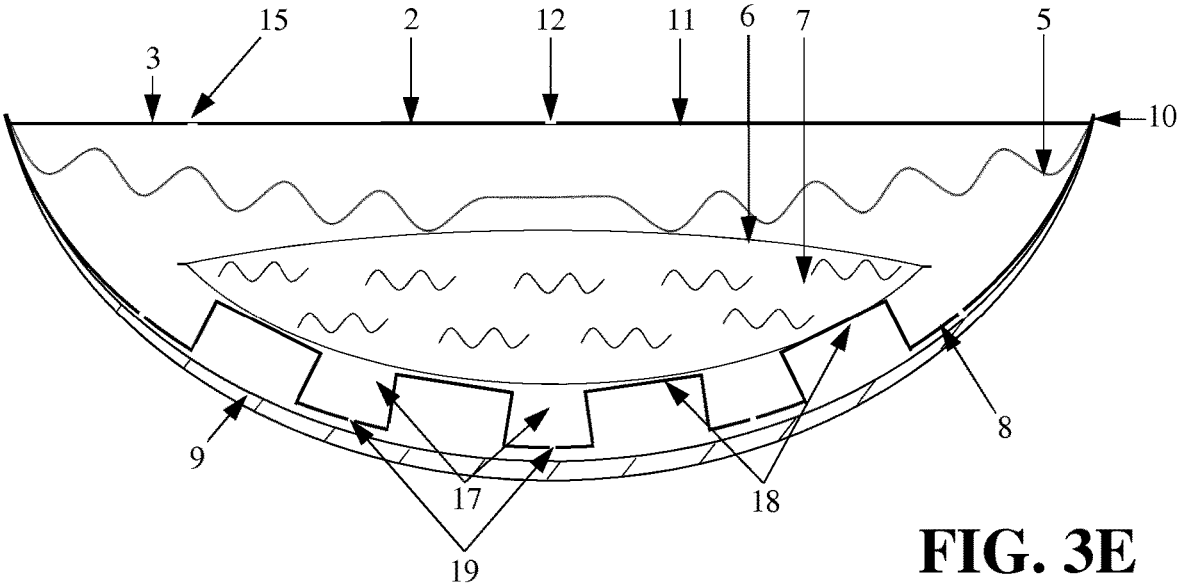
FIG. 3E is a variant of the front cross-sectional view FIG. 3A for smaller capsules.

The grip 2 may include a means 21 for opening the capsule 6 that is attached to the bottom (or is a part) of the grip 2 and freely extends beyond the hinge 12 under the fixed portion 11 of the semi-rigid membrane 1 (FIGS. 1D, 3C). When the grip 2 rises into the vertical working position by turning around the hinge 12, so does the attached part of the means 21 (above the hinge 12) while its free extension (beyond the hinge 12) lowers and compresses and opens the capsule 6 (FIGS. 1E, 3D). The length of the free extension of the means 21 should be sufficient to open the capsule 6, however, not longer than the shortest distance between the hinge 12 and the opposing dissector 8 or than the maximal elongation of the impermeable membrane 5 to ensure an unobstructed turning of the means 21 in the dissector 8 cavity into the vertical position (FIG. 3D). In a preferred embodiment, the shape of the means 21 free extension essentially (inasmuch as allowed by the elongation of the impermeable membrane 5) matches the shallowest profile of the dissector 8 that the means 21 crosses upon turning into the vertical position (for shallow semispherical applicators of this invention, the shallowest profile of the dissector 8 appears in the applicator frontal cross-sections FIGS. 3A-3D) to ensure a dependable opening and emptying of the capsule 6 as well as an unobstructed turning of the means 21. Anyway, the means 21 free extension should preferably have a semicircular shape (for a smoother turning and achieving a fuller compression and dependable opening and emptying of the capsule 6) and be flat (to save space under the fixed portion 11 in the storage position). The means 21 can be made of the same material as the semi-rigid membrane 1 or of another material that is sufficiently rigid to break the capsule 6.

Although only a limited number of specific embodiments have been described in detail, such description is not to be taken as a limitation of the present invention. The description has been given only as illustration and example. To those skilled in the art, it will be readily apparent that changes may be made without departing from the spirit of the disclosed inventive concepts. The scope of the invention is to be defined by the appended claims.

The invention claimed is:

1. A hand applicator of liquids from openable capsules includes from top to bottom an impermeable membrane (5), an openable capsule (6) of a liquid (7), a non-collapsible concave dissector (8), and an absorber (9) and an edge seam (10), characterized in that said impermeable membrane (5) is unfolding and elongating such that it is folded together in the storage position, except for its flat edge (16) that is welded into said seam (10), and unfolds and straightens in the direction of the finger pressure on said capsule (6) through said impermeable membrane (5).

2. The applicator of claim 1 wherein said impermeable membrane (5) is concentrically folded.

3. The applicator of claim 1 wherein said impermeable membrane (5) is transparent and said capsule (6) is a plurality of capsules.

4. The applicator of claim 1 wherein said dissector (8) has elevations (18) on its inside and perforations (19) between said elevations (18) for an unobstructed draining space (17) for said liquid (7) and wherein said capsule (6) includes an actuator (20) that is greater than the size of said perforations (19).

5. The applicator of claim 1 including outside said impermeable membrane (5) a semi-rigid membrane (1) including a raisable grip (2) with a hinge (12) at its base and a fixed portion (11).

6. The applicator of claim 5 wherein said hinge (12) has a more pliable central part (13).

7. The applicator of claim 5 wherein said grip (2) is cut through said semi-rigid membrane (1).

8. The applicator of claim 5 wherein the opposite sides of said grip (2) and said semi-rigid membrane (1) are connected by one or more breakable bridges (15).

9. The applicator of claim 5 wherein said grip (2) has an edge cut-out (4) for raising said grip (2).

10. The applicator of claim 5 wherein said semi-rigid membrane (1) includes a bending segment (3) opposite said grip (2) for a finger access under said grip (2) for bringing the applicator into the working position.

11. The applicator of claim 10 wherein said grip (2) and said segment (3) have congruent opposite sides.

12. The applicator of claim 10 wherein the opposite sides of said grip (2) and said segment (3) are connected by one or more breakable bridges (15).

13. The applicator of claim 5 wherein said grip (2) includes a means (21) for opening said capsule (6) upon turning said grip (2) around said hinge (12) into the working vertical position, wherein said means (21) freely extends beyond said hinge (12) under said fixed portion (11).

14. The applicator of claim 13 wherein the shape of said means (21) free extension essentially matches the shallowest profile of said dissector (8) that said means (21) crosses upon turning into the vertical position.

15. The applicator of claim 13 wherein said means (21) free extension is semicircular.

16. The applicator of claim 13 wherein said means (21) free extension is flat.

* * * * *